US005160785A

United States Patent [19]

Davidson, Jr.

[11] Patent Number: 5,160,785

[45] Date of Patent: Nov. 3, 1992

[54] PADDING BODY

[75] Inventor: Paul R. Davidson, Jr., Richmond, Va.

[73] Assignee: E. R. Carpenter Company, Inc., Richmond, Va.

[21] Appl. No.: 727,844

[22] Filed: Jul. 9, 1991

Related U.S. Application Data

[63] Continuation-in-part of Ser. No. 713,336, Jun. 11, 1991.

[51] Int. Cl.[5] ..... B32B 3/26; A47C 27/00; A47C 27/14

[52] U.S. Cl. ..... 428/316.6; 5/480; 5/481; 297/DIG. 1; 428/159; 428/160; 428/180

[58] Field of Search ..... 5/480, 481; 297/DIG. 1; 428/316.6

[56] References Cited

U.S. PATENT DOCUMENTS

| | | | |
|---|---|---|---|
| 2,295,363 | 9/1942 | Scott | 5/636 |
| 2,315,391 | 3/1943 | Blair | 5/636 |
| 3,258,791 | 7/1966 | Kaplan | 5/481 |
| 3,512,190 | 5/1970 | Buff | 5/481 |
| 3,681,797 | 8/1972 | Messner | 5/347 |
| 4,042,987 | 8/1977 | Rogers | 5/345 R |
| 4,110,881 | 9/1978 | Thompson | 29/91.1 |
| 4,399,574 | 8/1983 | Shuman | 5/417 |
| 4,603,445 | 8/1986 | Spann | 5/481 |
| 4,673,452 | 6/1987 | Awdhan | 156/254 |
| 4,686,724 | 8/1987 | Bedford | 5/468 |
| 4,777,855 | 10/1988 | Cohen | 83/862 |
| 4,809,374 | 3/1989 | Saviez | 5/420 |
| 4,879,776 | 11/1989 | Farley | 5/434 |
| 4,901,387 | 2/1990 | Luke | 5/464 |

*Primary Examiner*—George F. Lesmes
*Assistant Examiner*—Chris Raimund
*Attorney, Agent, or Firm*—Beveridge, DeGrandi & Weilacher

[57] ABSTRACT

A resilient padding body which comprises an intermediate base layer and upper protruberances extending upwardly off the surface of the base layer and bottom protruberances extending downwardly off a lower surface of the base layer. The padding body includes longitudinal and lateral upper recesses which are formed between the upper protruberances. The upper protruberances have side walls which slope inwardly to form an object which is in the shape of a trancated pyramid and angled recesses. The base of the upper protruberances is essentially coplanar with the base member's upper surface. The base of each upper protruberance is separated by a slit which extends into the base member for about one half of the base member's thickness. The bottom protruberances include foundation sections which have vertical side walls. The foundation sections are spaced sufficiently to form a narrow channel between adjacent foundation section walls. A truncated pyramid shaped lower section extends downwardly off each of the foundation sections to form longitudinal and lateral angled recesses which open into the channels.

23 Claims, 6 Drawing Sheets

PADDING BODY

CROSS REFERENCE TO RELATED APPLICATIONS

This application is a continuation-in-part of commonly assigned U.S. patent application Ser. No. 07/713,336 filed Jun. 11, 1991 is now pending and entitled PILLOW.

BACKGROUND OF THE INVENTION

1. Field of the Invention

This invention pertains to a padding body such as a foam padding body used in the formation of articles such as pillows, seat cushions, mattresses and mattress overlays.

2. Background Discussion

The prior art has introduced various padding body designs in attempting to achieve a versatile and comfortable padding body. For example, U.S. Pat. No. 4,809,374 to Saviez reveals a padding body formed by independent modular elements held in position by a plastic plate or grid. The plate or grid includes square meshes defining openings for receipt of the modular elements which can be varied in height and/or material. The modular elements are formed of a foam material and are designed to include a base section with one protuberance extending thereoff or a pair of protuberances extending to opposite sides of the base. The opening in the plate or grid is of a size which allows a protuberance to fit snugly therein but is smaller than the cross-section of the base.

U.S. Pat. No. 4,110,881 to Thompson illustrates the use of slots in a resilient article with the slots arranged in a rectangular grid. The slots vary in spacing and/or depth so as to tailor compressibility to accommodate for unequal loading.

The Thompson patent further illustrates how yield is influenced by compression as well as by a combination of forces including tension. The slits in the Thompson patent are described as assisting in the separation of compression and tension.

U.S. Pat. No. 4,042,987 to Rogers further reveals a mattress pad having a criss-crossing slit arrangement provided such that the shear stresses involved in transforming compressive loads into surface strain are fragmented.

The characteristics of a padding body required for achieving high comfort, while also allowing for good blood circulation in the user of the pad, include the following:

(1) A reduction in surface tension so as to avoid a shearing effect on the user of the padding body;

(2) A minimization in body surface contact while, at the same time, providing sufficient support;

(3) The creation of a therapeutic cradling effect between compressed and non-compressed modules while maintaining the shearing effect to a minimum and providing sufficient support;

(4) Maintaining an independent suspension among the modules of the padding for enhanced load bearing while allowing for load shifts and an ensurance of sufficient structural integrity;

(5) Forming the padding body of a material and of a design which is soft to the feel, provides sufficient support and avoids bottoming out.

The foregoing characteristics of a padding body are highly interrelated and adjustments to improve one of the above characteristics can lead to a degradation in one or more of the other characteristics. For example, the above-noted patent to Saviez, in addition to the problems associated with assembling the multitude of components, relies on a semi-rigid grid or plate. This semi-rigid grid or plate, while providing structural integrity, creates a stub like effect with regard to the upper protuberances. That is, the semi-rigid plate surrounding the protuberances limits the flexing ability at the foundation of each protuberance during shifts in loading. In addition, the contact between the essentially non-giving, semi-rigid plate and the individual modules leads to the development of shearing forces within each module which can be transferred to the person in contact with the module. The ability of the modules to flex with shifting loads can be enhanced by lessening the cross-sectional periphery of each protuberance and/or increasing the length of the protuberances, but that would lead to degradation of other padding characteristics such as a firm, non-wobbly support. Also, the use of a semi-rigid plate with edges extending about the periphery would require additional padding about the edges if the padding body is to be used as a pillow or seat cushion where contact with the edge of the padding occurs.

The rectangular grid of modules disclosed in the above-noted Thompson and Rogers patents, while providing for a reduction in tension, fail to minimize body contact. Also, the close proximity of each module lessens the independent suspension of each module due to interaction between the modules during compression (bulging) and non-vertical loading.

SUMMARY OF THE INVENTION

The padding body of the present invention provides a coordinated integration of padding components which achieves a high degree of all of the above-noted characteristics associated with a comfortable padding body without appreciably sacrificing one advantageous characteristic in favor of another.

The coordinated integration of components used to achieve the advantageous nature of the present invention includes:

(1) Reducing surface contact pressure and minimizing surface tension by having symmetrical intersecting channels and recesses;

(2) Creating a system of interlocking but independent protuberances that move as the applied load moves;

(3) Creating a therapeutic cradling effect between compressed and non-compressed modules;

In so doing, the padding body of the present invention features a compressible base member having an upper and a lower surface. A set of upper compressible protuberances extend off of the upper surface of the base member and the upper protuberances are separated from one another by a series of parallel, spaced longitudinal and lateral upper recesses.

A set of compressible bottom protuberances extend off the lower surface of the base member and are separated from one another by a series of parallel, spaced longitudinal and lateral bottom recesses.

A series of longitudinal and lateral slits are formed in the base member so as to extend vertically downward from the upper surface of the base member down into the base member's interior (e.g., 40 to 50% of the total thickness of the base member). As the slits do not extend entirely through the base member, a continuous band of material is provided between the lower ends of the slits and the lower surface of the base member.

The preferred embodiment of the invention features a padding body formed as a unitary body and of the same or common material. Although various materials can be relied upon in accordance with the desired resultant characteristics and the manner in which the invention is to be used, a suitable material for the purposes of the invention is a polyurethane foam material having an average density of 1.75 lb/ft$^3$ and an ILD value of 11-16 lbs/psi and a compression modulus of 2.8-3 (ratio of 65% ILD to 25% ILD). This material is particularly suitable with use of the present invention as a pillow shaped foam pad.

The slits formed in the upper portion of the base member are sufficiently thin such that, when the base member is horizontal, the adjacent surfaces on each side of the slits are in contact. This contacting arrangement is made possible by the inherent nature of the foam material to expand outwardly after cutting has taken place.

The preferred arrangement of the padding body has the lateral and longitudinal upper and bottom recesses extending continuously along the respective upper and lower surface of the base member. The longitudinal recesses are equally spaced from one another and the lateral recesses are equally spaced from one another with the spacing being the same for both the longitudinal and lateral recesses. In this way, the intersecting recesses (both above and below) define square bases for the upper and lower protuberances (except for certain areas about the periphery where partial protrusions are provided). Although less preferable, the present invention also contemplates the formation of non-square quadrilateral protuberance foundations through appropriate manipulation of the spacing of the criss-crossing upper and bottom recesses. This non-square protuberance arrangement would be useful, for instance, in situations where horizontal loads are continuously applied in one direction but not generally transverse to that direction.

Also, the preferred invention spaces and positions the longitudinal and lateral recess such that each upper longitudinal recess is directly above a bottom longitudinal recess and each upper lateral recess is directly above a bottom lateral recess. In this way, a vertical plane bisecting either an upper longitudinal or lateral recess will bisect an underlying bottom longitudinal or lateral recess.

The upper protuberances are in the shape of a truncated pyramid with the base commensurate or essentially coplanar with the upper surface of the base member. The walls of the upper protuberances slope inwardly at an angle preferably from 6° to 10°. This results in the longitudinal and lateral upper recesses being angled in an upwardly divergent manner.

The bottom protuberances each include a foundation section extending from (or essentially from) the lower surface of the base member. The foundation section is defined by walls extending transversely with respect to the horizontal, planar lower surface of the base member. The bottom protuberance further includes a lower section which is of a truncated pyramid shape. The walls of the lower section preferably slope outwardly at an angle from 7° to 11°. The vertical side walls of the foundation section are spaced by about 4 to 6 mms such that a channel is formed therebetween. The channel forms part of the bottom recess and thus opens into the angled recess section lying between the lower section's side walls. The foundation section constitutes about 50% of the total length of the bottom protuberances.

The padding body of the present invention is particularly suited for use as a pillow. The embodiment of the invention which is in the form of a pillow features two side walls (e.g., the shorter end walls) that are convexly curved.

The padding body of the present invention preferably has a planar upper and bottom surface provided by extending the upper protuberances out the same length and the bottom protuberances out the same length. The surface at the top of each truncated upper protuberance lie on the same plane to define the planar upper surface. Also, the truncated lower sections lie on the same plane so as to define the bottom surface of the padding body.

Also, the distance the bottom protuberances extend from the lower surface of the base member is preferably about 1.25 to 1.75 times longer than the length the upper protuberances extend off the upper surface of the base member.

Also, by vertically aligning the upper and bottom recesses the vertical central axis of the upper protuberances is colinear with the vertical axis of the underlying bottom protuberances.

DETAILED DESCRIPTION OF THE PREFERRED EMBODIMENT

Figure 1:
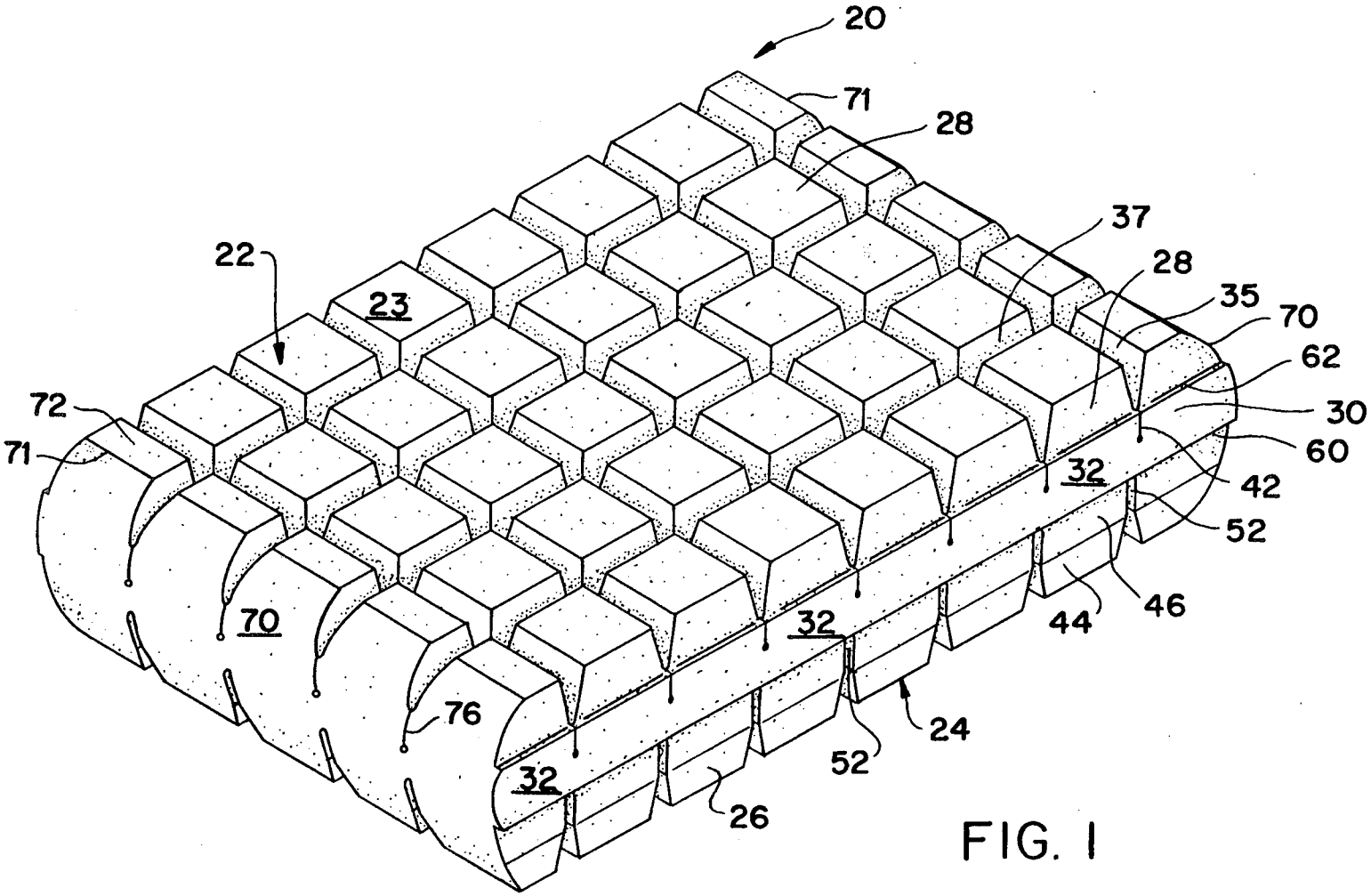
FIG. 1 is a perspective view of a padding body according to the present invention.

FIG. 1 illustrates a perspective view of a preferred embodiment of the present invention. As shown in FIG. 1 padding body 20 is in the form of a pillow. The advantageous characteristics of the present invention also make the padding body useful for other articles such as seat cushions, mattresses, mattress overlays, etc. The dimensions and description to follow are directed at a preferred embodiment of the invention which is in the form of a pillow but have applicability in the other uses described above.

FIG. 1 illustrates interconnecting upper longitudinal and lateral recesses 37, 35, respectively. The interconnecting upper longitudinal and lateral recesses define between their points of intersection upper protuberances 28. Upper protuberances 28 are shown to be in the form of truncated pyramids with inwardly sloping side walls and an upper, planar surface 23. Each upper, planar surface 23 is at the same level so as to define an upper planar padding body surface which is generally designated 22 in FIG. 1.

Upper protuberances 28 have a base which is essentially coplanar with upper surface 62 of base member 30. A plurality of lateral slits 42 and longitudinal slits 76 extend from the upper surface 62 of base member 30 vertically down into base member 30 for, preferably, 40 to 50% of the total thickness of base member 30 and, more preferably, 45%. Slits 42 and 76 each extend for an equal distance into base member 30 such that a continuous band 32 of solid material is provided between the bottom of the slits and lower surface 60 of base member 30. This continuous band 32 of material, in essence, provides the "backbone" of the padding body 20. However, as longitudinal and lateral slits 42 and 76 are thin, the adjacent surfaces of base member 30 which define the slits are in contact when base member 30 is horizontally positioned. Since slits 42 and 76 are coplanar with the bisects of the above lying longitudinal and lateral recesses, the quadrilateral section defined by the slits functions not only as part of base member 30 but also forms the base or foundation of upper protuberances 28. This is particularly useful for the purpose of developing the independent suspension of upper protuberances 28 while maintaining a high degree of structural integrity as will be explained in greater detail below.

FIG. 1 further reveals bottom protuberances 26 extending off lower surface 60 of base member 30. Each of bottom protuberances 26 extend an equal distance off lower surface 60 so as to define planar, bottom surface 24 of padding body 20. Bottom protuberances 26 feature a foundation section 46 and a lower section 44 which is shaped as a truncated pyramid. Foundation section 46 is defined by side walls extending transversely off from lower surface 60. The transverse walls are spaced a greater distance apart than the slits 42 and 76 (located directly above) such that lateral channels 52 and longitudinal channels 79 (FIG. 4) are formed.

FIG. 1 still further illustrates curved sides 70, which, along upper edge 71, border partial upper protuberances 72 with the latter being level with the remaining full upper protuberances 28.

Figure 2:
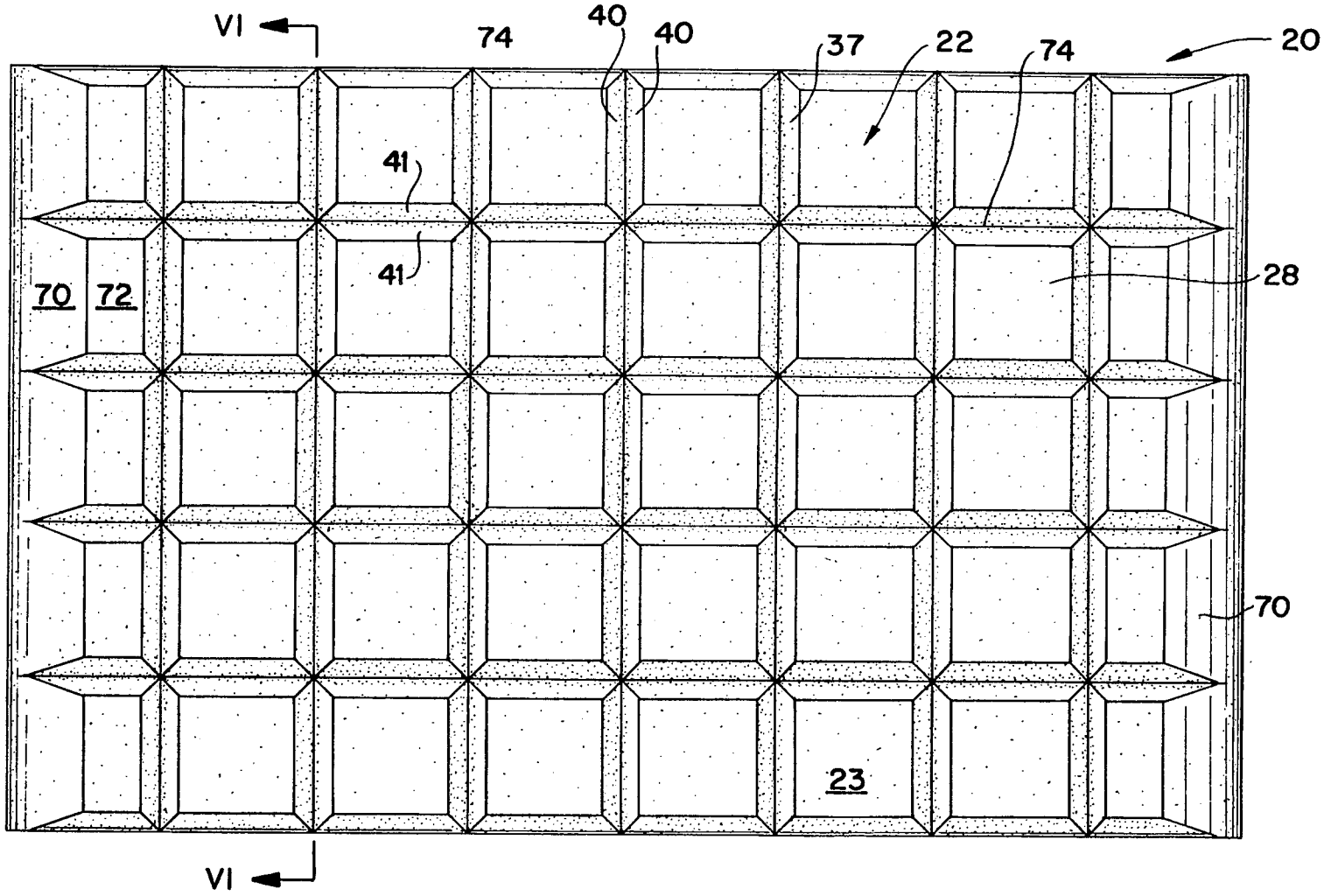
FIG. 2 is a top plan view of the padding body shown in FIG. 1.

FIG. 2 provides a top plan view of that which is shown in FIG. 1. As shown in FIG. 2, lateral side walls 40 of upper protuberances 28 slope inwardly and downwardly to the upper surface of base 30 and the upper end of slits 42 (FIG. 1). Thus, side walls 40 define upwardly divergent lateral angled recesses 37. In a similar manner, sloping longitudinal side walls 41 define upwardly divergent longitudinal angled recesses 74.

Figure 3A:
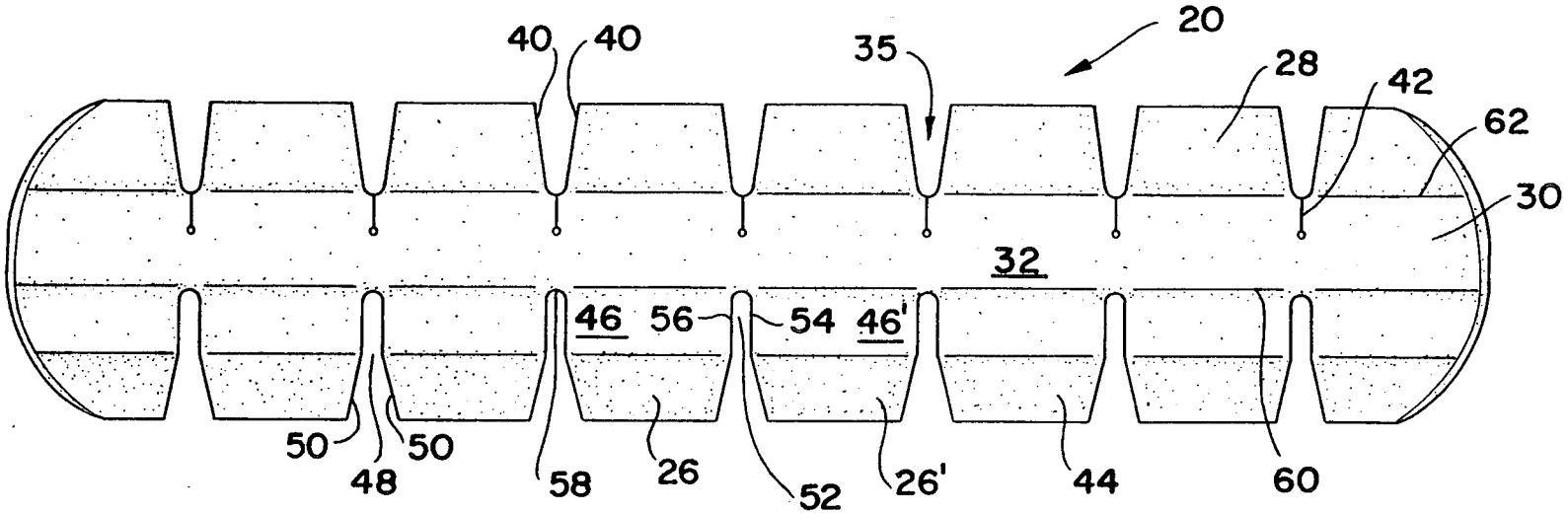
FIG. 3A is a front elevational view (or rear elevational as both views present the same illustration) of the padding body shown in FIG. 1.
Figure 3B:
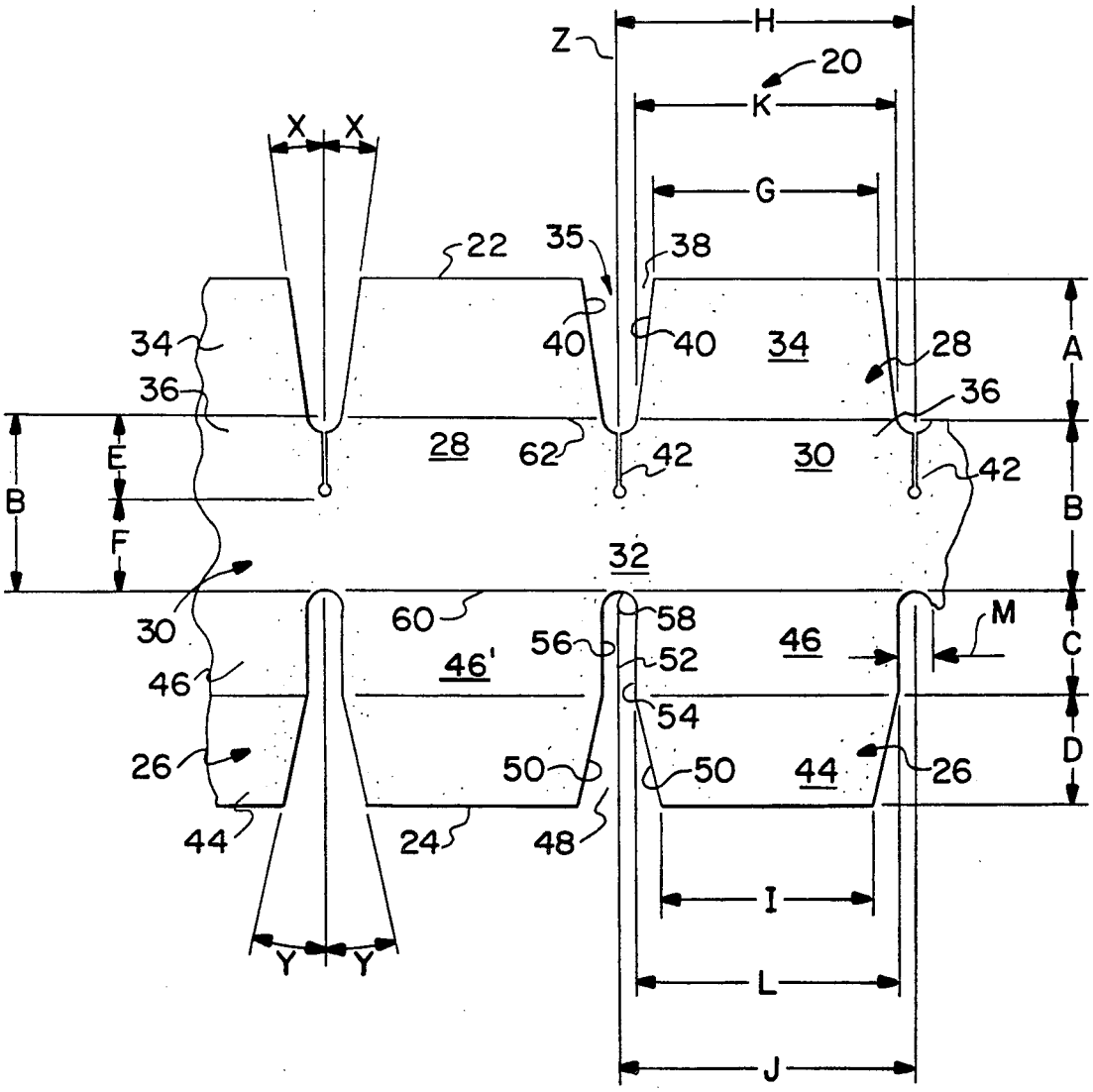
FIG. 3B is a blown up view of a portion of the front elevational view shown in FIG. 3A.

FIG. 3A shows a front elevation view of padding body 20 while FIG. 3B provides a more detailed, cutaway view of the mid portion of that which is shown in FIG. 3A. With reference to FIGS. 3A and 3B, there is illustrated in greater detail, sloping lateral side walls 40 of upper protuberance 28. Preferably lateral side walls 40 (and longitudinal side walls 41, FIG. 2) slope inwardly from vertical plane Z at an angle X from 6° to 10° and more preferably about 8°.

FIGS. 3A and 3B further illustrate lateral channel 52 formed between vertical side walls 54 and 56 o adjacent bottom protuberances 26 and 26' or, more specifically, adjacent vertical side walls of adjacent foundation sections 46 and 46'.

The end 58 of channel 52 is preferably coplanar or essentially coplanar (±5 mm) with lower surface 60. Similarly, the base of upper protuberances 28 is preferably coplanar or essentially coplanar (±5 mm) with regard to upper base member surface 62.

The open end of channel 52 opens into bottom lateral recess 48 with bottom lateral recess 48 being formed by lateral side walls 50 of truncated lower section 44. Sloping side walls 50 preferably slope away from vertical plane Z at an angle Y which is from 7° to 11° and more preferably is 9°.

FIG. 3B illustrates how vertical plane Z bisects lateral angled recess 37, slit 42, channel 52 and bottom angled recess 48 such that the central axis of upper and bottom protuberances 26 and 28 are colinear.

FIG. 3B also designates the preferred dimension of the padding body illustrated in FIG. 1 and dimensioned for use as a pillow. The preferred dimensions are as follows (in mm's):

A—36.0
B—46.6
C—28.15
D—29.0
E 21.0
F—25.6
G—60.7
H—80.0
I—57.7
J—80.0
K—70.7
L—70.7
M—5.0

The height of upper protuberance and lower protuberances 26, 28 can be varied in accordance with the type of material being used. The dimensions given above are suited for a polyurethane pillow having the following characteristics:

| Characteristic | Preferred Range |
|---|---|
| Density | 1.0–2.0 |
| 25% ILD | 10–25 |
| 65% ILD | 35–45 |
| CM (65%/25%) | 2.0–3.3 |

A suitable material for use with padding body 20 is a material manufactured by E. R. Carpenter Company, Inc. of Richmond, Va. having the trademark QUALUX or RICHFOAM. More particularly, the materials preferred have the following characteristics:

| FOAM TYPE | DENSITY | 25% ILD | 65% ILD | MODULUS |
|---|---|---|---|---|
| R17XR | 1.00–1.10 | 20.0 | 41.0 | 2.05 |
| Q11 | 1.70–1.80 | 14.3 | 41.0 | 2.87 |

As noted above, the preferred material forming padding body 20 has preferable Indentation Load Deflection (ILD) values for the 25 and 65% deflection points. The "ILD" values represent the amount of displacement force required to displace a pad a predetermined percentage (e.g., 5, 25 and 65%) of the pad's total thickness. Thus a foam pad having an ILD value of 14 for a deflection of 25% would require a load of 14 lbs (applied for example by a metal plate having a one foot square surface area) to deflect a 4 inch thick pad 1 inch.

Figure 4:
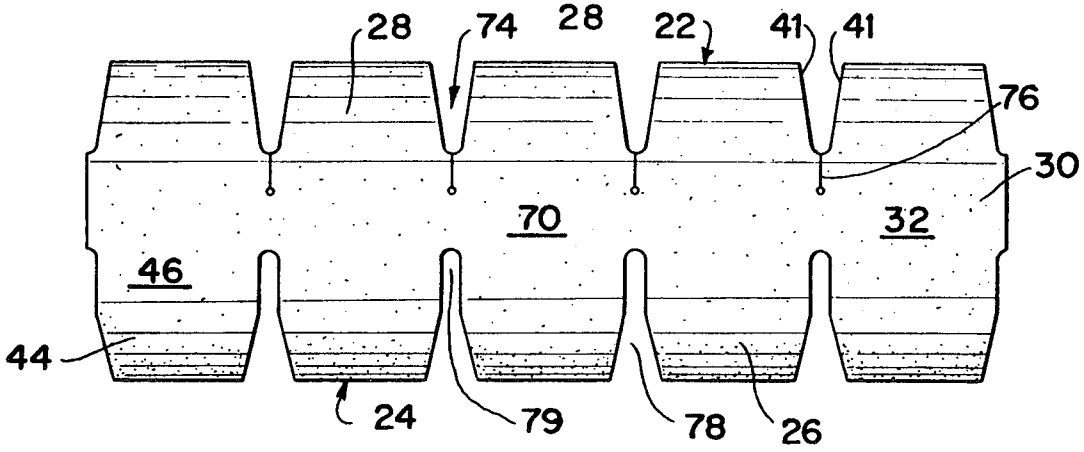
FIG. 4 is a side elevational view of the padding body shown in FIG. 1 (with each side presenting the same view)

FIG. 4 illustrates a side elevational view (either of the two shorter end sides as both present the same view). As shown in FIG. 4, longitudinal upper angled recesses 74 are defined by downwardly sloping longitudinal side walls 41 of upper protuberances 28. At the bottom of recesses 74 are provided longitudinal slits 76 which partially extend into base member 32 so as to leave continuous band 32.

FIG. 4 also illustrates longitudinal channels 79 which open into bottom angle recess section 78. The dimensions and angles given for the lateral orientation in FIG. 3B apply equally well to the longitudinal orientation shown in FIG. 4; that is, the slope of the side walls, the depth of the recesses, etc. Also, a vertical plane would bisect channel 79, slit 76, upper recess 74 and lowermost angled recess 78 as described above for the laterally orientated recess channel and slit.

Figure 5:
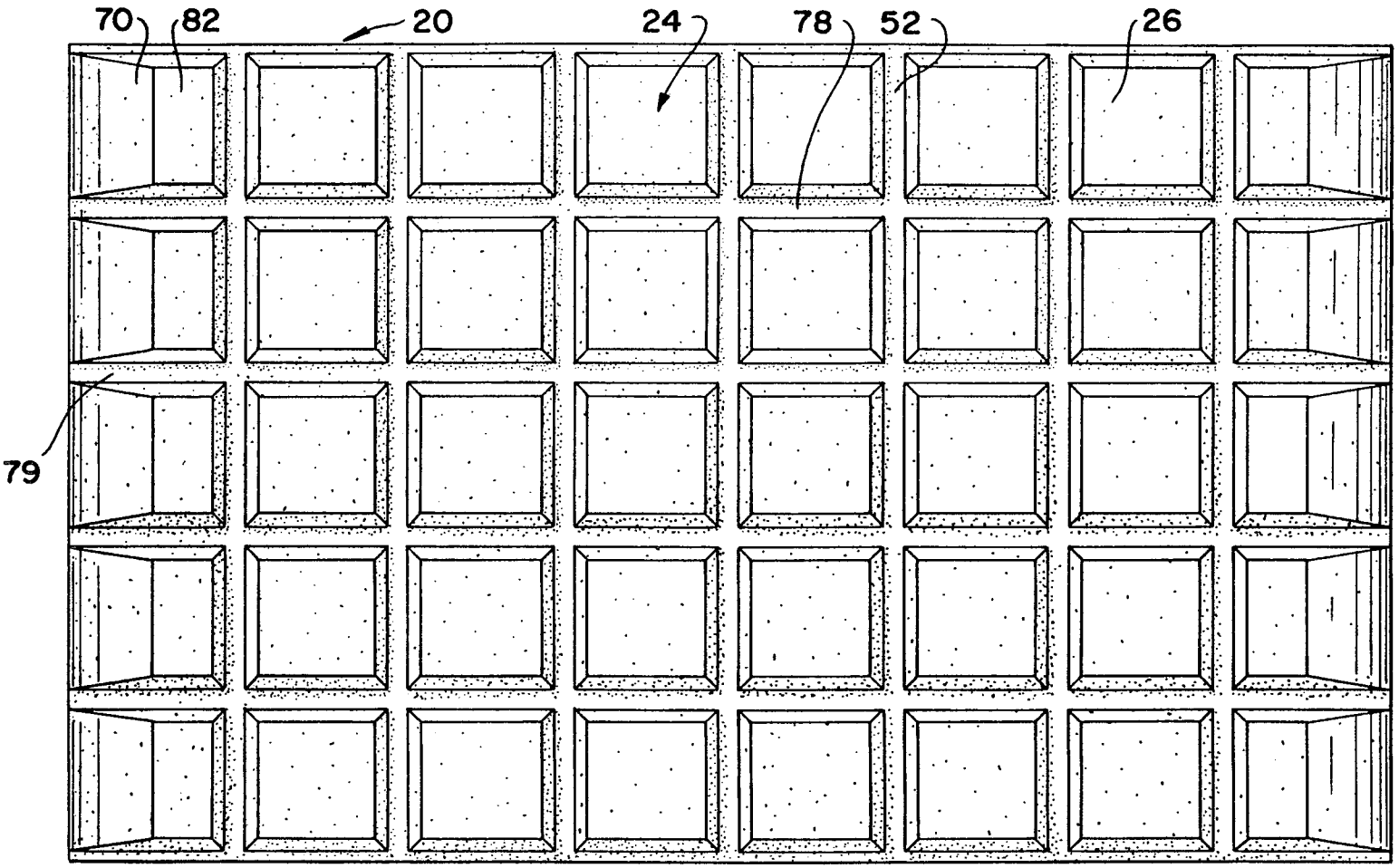
FIG. 5 is a bottom plan view of the padding body shown in FIG. 1.

FIG. 5 provides a bottom plan view of padding 20 with curved side 70 leading into an upper surface of partial bottom protrusion 82.

Figure 6:
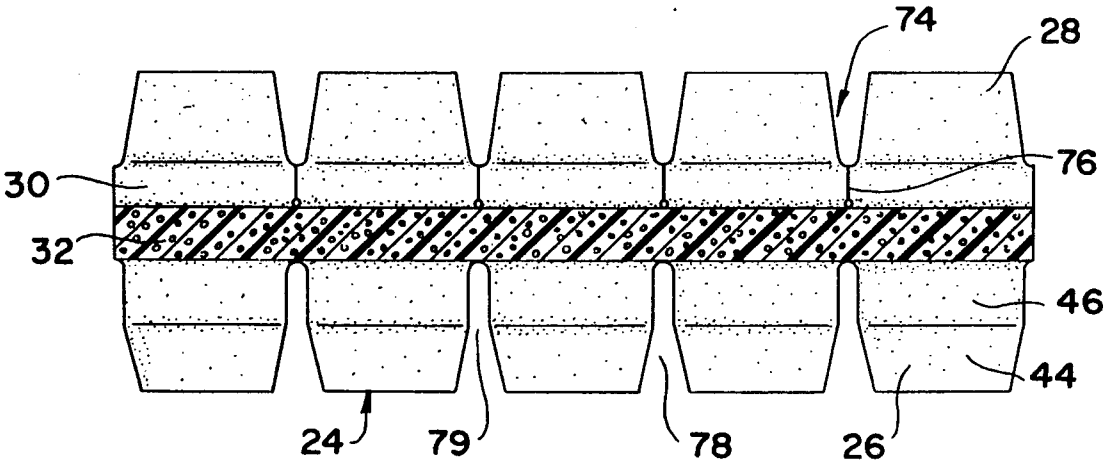
FIG. 6 is a cross-sectional view of the foam pad taken along cross-section line VI—VI in FIG. 2.

FIG. 6 shows a cut-away view taken along cross-section line VI—VI in FIG. 2. FIG. 6 illustrates the continuous nature of band 32 and the extension of slits 76 to the upper surface thereof.

The above described arrangement of padding body 20 provides for a comfortable pad as well as good blood circulation in the user. The truncated upper protuberances 28 provide relatively large recess areas therebetween which ensures an independent suspension in each protuberance and sufficient room for any horizontal expansion of the protuberances. The arrangement of the upper truncated protuberances further provides for a minimization of body surface contact while providing good support.

The slits further enhance the independent suspension of the pillow while maintaining structural integrity of the pillow and avoiding undue lateral shifting of the upper protuberances. Also, the slits allow for an added degree of freedom in having the upper planar surfaces of each protuberance tilt to conform to an angled surface presented by the user (e.g., the back of the head). This tilting freedom enhances the ability of the pad to provide a therapeutic cradling effect.

The longitudinal and lateral bottom angled recesses (48,78) are larger than the longitudinal and lateral channels (52,79) and diverge the same or more (one to two degrees) than the upper longitudinal and lateral recesses (38,74). Hence, the bottom angled recesses help to enhance the independent suspension of the above positioned protuberances. This enhanced independent suspension in the bottom protuberances is believed to help prevent the passage of horizontal forces that develop below the base member and thus lessen the amount of horizontal shear forces that can be transmitted through the intermediate base member to the upper protuberances. The channels (52,79) are somewhat narrower to help avoid too much lateral shifting in the bottom protuberances while maintaining the independent suspension of the bottom protuberances.

If an increase in the thickness of continuous band 32 is made or if the pad is made solid below upper protuberances 28, it is believed that the horizontal loads acting on the lower portion in padding body 20 would have a greater tendency to be transmitted to the upper surface such that some of the advantageous independent suspension effect would be lost. Forming the slits of two great a length with respect to the thickness of the base member, results in a reduction in structural integrity which can lead to difficult handling (too floppy) and greater potential for a "bottoming out" effect. Accordingly, the longitudinal and lateral slits extend for about 40 to 50% of the base member which base member constitutes 25 to 35% of the entire pad thickness, or more preferably 33%.

The specific design of the individual protuberances of the present invention is particularly suited for avoiding the creation of surface tension and the resultant discomfort. For example, the top truncated section of the upper protuberances move independently as an applied load moves, i.e., up and down, side to side. Thus, an applied force to the top surface of a few upper protuberances would result in compression of those blocks without subsequent effect on the surrounding blocks. This capability is enhanced by the vertical slits extending into the base. Without these slits, an applied force to those few protuberances would result in a greater degree of lateral pull or pressure on the surrounding protuberances causing a closing or narrowing of the angled recessed. This lateral pull would cause an increased surface tension as the protuberances all bunch together and surface tension translates to increased pressure points working against blood circulation. The arrangement of the present invention, however, lessens the tendency for surface tension to arise due to the lateral pull of adjacent protuberances.

The method for forming the above described padding body 20 can take any form conventional in the art such as any one or a combination of methods such as hot wire cutting, molding, and programmable contour cutting with the latter being the preferred method.

Although the present invention has been described with reference to a preferred embodiment, the invention is not limited to the details thereof. Various substitutions and modifications will occur to those of ordinary skill in the art, and all such substitutions and modifications are intended to fall within the spirit and scope of the invention as defined in the appended claims.

What is claimed is:

1. A padding body, comprising:

a compressible base member having an upper and a lower surface;

compressible upper protuberances extending off of the upper surface of said base member, said upper protuberances being separated from one another by upper recesses which extend to said base member;

compressible bottom protuberances extending off of the lower surface of said base member, said bottom protuberances being separated from one another by bottom recesses;

said base member having slits formed therein which open into the upper recess and which extend below the upper recesses into said base member, said slits extending into said base member such that said base member includes a continuous band of material between an end of said slits and the lower surface of said base member.

2. A padding body as recited in claim 1, wherein said padding body is a unitary member formed of a single type of material.

3. A padding body as recited in claim 2, wherein the padding body is formed of a foam material.

4. A padding body as recited in claim 1, wherein said slits are dimensioned and arranged such that adjacent surfaces of said base member on each side of said slits are in contact when said base member is horizontally orientated and said slits being vertically oriented and positioned essentially coplanar to a vertical plane bisecting said upper recesses.

5. A padding body as recited in claim 1, wherein said upper and bottom recesses are continuous and extend in longitudinal and lateral directions so as to intersect and form said upper and bottom protuberances which are quadrilateral in cross-section.

6. A padding body as recited in claim 5, wherein the upper longitudinal and lateral recesses are equally spaced with respect to the bottom longitudinal and lateral recesses such that a plane bisecting an upper longitudinal or lateral recess bisects an underlying bottom longitudinal or lateral recess.

7. A padding body as recited in claim 6, wherein said upper protuberances include side walls which slope outwardly in an upward direction from essentially the upper surface of said base member such that the longitudinal and lateral upper recesses diverge in an upward direction.

8. A padding body as recited in claim 7, wherein said side walls of said upper protuberances slope outwardly at an angle from 6° to 10°.

9. A padding body as recited in claim 5, wherein said upper protuberances include side walls which slope outwardly in an upward direction from essentially the upper surface of said base member such that the longitudinal and lateral upper recesses diverge in an upward direction.

10. A padding body as recited in claim 9, wherein said side walls of said upper protuberances slope outwardly at an angle from 6° to 10°.

11. A padding body as recited in claim 9, wherein said bottom protuberances each include a foundation section defined by walls extending transversely with respect to the bottom surface of said base member, said transversely extending walls being spaced from one another so as to define lower channels in said bottom recesses, and a lower truncated section extending off of said foundation section and formed of outwardly sloping side walls, said outwardly sloping side walls of said lower truncated section defining a lower angle recess section in said bottom recesses.

12. A padding body as recited in claim 11, wherein the outwardly sloping walls of said lower truncated section slope outwardly at an angle from 7° to 11°.

13. A padding body as recited in claim 1, wherein said slits extend in said base member for 40 to 50% of the thickness of said base member.

14. A padding as recited in claim 1, wherein said slits extend for 45% of the thickness of said base member.

15. A padding body as recited in claim 1, wherein said padding is formed of polyurethane foam having a density from 1.0 to 2.0 lbs/ft$^3$, a 25% ILD value of 10 to 25 lbs/psi and a compression modulus of 2.0 to 3.3.

16. A padding body as recited in claim 1, having a curved left and right side surfaces so as to provide a pillow-shaped padding body.

17. A padding body as recited in claim 1, wherein said bottom protuberances each extend the same distance away from the lower surface of said base member and said upper protuberances each extend the same distance off said upper surface of said base member.

18. A padding body as recited in claim 17, wherein said bottom protuberances are longer than said upper protuberances by a ratio of 1.25:1 to 1.75:1.

19. A padding body as recited in claim 1, wherein said slits are vertically orientated and said upper protuberances are truncated, and said bottom protuberances include a foundation section with four vertical walls and a truncated lower section extending off from said foundation section.

20. A padding body as recited in claim 19, wherein said foundation section comprises about 50% of the total length of said bottom protuberances.

21. A padding body as recited in claim 1, wherein a vertical plane bisecting an upper protuberance also bisects a bottom protuberance.

22. A padding body as recited in claim 1, wherein said upper and bottom recesses extend in longitudinal and lateral directions, and said upper protuberances are in the shape of a truncated pyramid with the base of said upper protuberances being coplanar with the upper surface of said base member, said upper protuberances including side walls defining said upper recesses, said bottom protuberances including a foundation section with vertically orientated walls, and said bottom protuberances including lower sections extending off said foundation sections, said lower sections being in the shape of a truncated pyramid, and said upper recesses, bottom recesses and slits being arranged such that a vertical plane bisecting through any one of said longitudinal or lateral upper recesses will bisect an underlying longitudinal or lateral slit and an underlying longitudinal or lateral bottom recess.

23. A padding body as recited in claim 1, wherein said base member constitutes 25 to 35% of the total padding body thickness and said slits extending into said base member for 40 to 50% of the total base member thickness.

* * * * *